US005408806A

United States Patent [19]

Lin et al.

[11] Patent Number: 5,408,806

[45] Date of Patent: Apr. 25, 1995

[54] HORIZONTAL TYPE OF PACKING MACHINE WITH AN ADJUSTABLE POUCH FORMER

[75] Inventors: Chin-Lin Lin; Shitsun Chen, both of Hsinchu, Taiwan, Prov. of China

[73] Assignee: Industrial Technology Research Institute, Hsinchu, Taiwan, Prov. of China

[21] Appl. No.: 101,410

[22] Filed: Aug. 3, 1993

[51] Int. Cl.[6] ..... B65B 9/06; B65B 9/00

[52] U.S. Cl. ..... 53/550; 53/551; 53/552; 493/476; 493/479

[58] Field of Search ..... 53/550, 450, 551, 552; 493/476, 479

[56] References Cited

U.S. PATENT DOCUMENTS 3,494,096 2/1970 Suzuki ..... 53/550
3,553,933 1/1971 Seko ..... 53/550

*Primary Examiner*—John Sipos
*Assistant Examiner*—Gene L. Kim
*Attorney, Agent, or Firm*—W. Wayne Liauh

[57] ABSTRACT

A horizontal type of packing machine with an adjustable pouch former, in which a guide screw having half left-handed threads and half right-handed threads is used for adjusting the width of the pouch former; a cylindrical gear is in mesh with two gears to drive a left and a right gear racks and to simultaneously adjust the height of two guide plates on both sides of the machine in order to adjust the height of the pouch former. According to the design of replaceable paper-guiding plates, a user can select the proper paper-guiding plates in accordance with the products and the packing paper for the purpose of increasing the function of the pouch former; the metal plate parts are used for forming a near quadric chain assembly by means of a rotary connector so as to have such parts moved and adjusted upon the adjustment of the pouch width.

5 Claims, 3 Drawing Sheets

HORIZONTAL TYPE OF PACKING MACHINE WITH AN ADJUSTABLE POUCH FORMER

BACKGROUND OF THE INVENTION

A horizontal type of packing machine is usually operated by following a process of paper feeding, product feeding, pouch forming and a sealing-and-cuting steps. In a packing operation, a packing machine has to be adjusted in some parts to meet the requirements of different products in size; otherwise, the packing operation is subject to interruptions and poor packing quality, i.e., the percent of defect will increase to jeopardize the good will in the market. To solve the aforesaid problem, an adjustable pouch former is deemed necessary.

In the adjustment process, the requirement of quickly and simply adjusting to the specifications desired is important, i.e., the symmetry of the pouch former has to be maintained without being re-designed during the adjustment. The design of the replaceable paper-guiding plates render the pouch former to have wider functions, and a user can select the proper paper-guiding plates in accordance with the characteristics of the products and the packing paper.

SUMMARY OF THE INVENTION

This invention relates to a horizontal type of packing machine with an adjustable pouch former, and particularly to a machine which has a guide screw having half left-handed threads and half right-handed threads for adjusting the width of the pouch former, and has a height adjusting function provided by means of the mesh of the gears and gear racks. A plurality of metal-plate parts with special shape are used as a paper-guide assembly so that a packing paper could move along the locus of the paper-guide assembly to form a pouch desired. The gears and the gear racks have been so designed that they can have both sides of the paper and the specifications adjusted simultaneously. The paper-guiding plates are designed to different pair sets for simple replacement and wide compatibility. The present invention is deemed a breakthrough over the conventional pouch former, and metal-plate parts can be adjusted automatically upon the width being adjusted.

DETAILED DESCRIPTION

Figure 1:
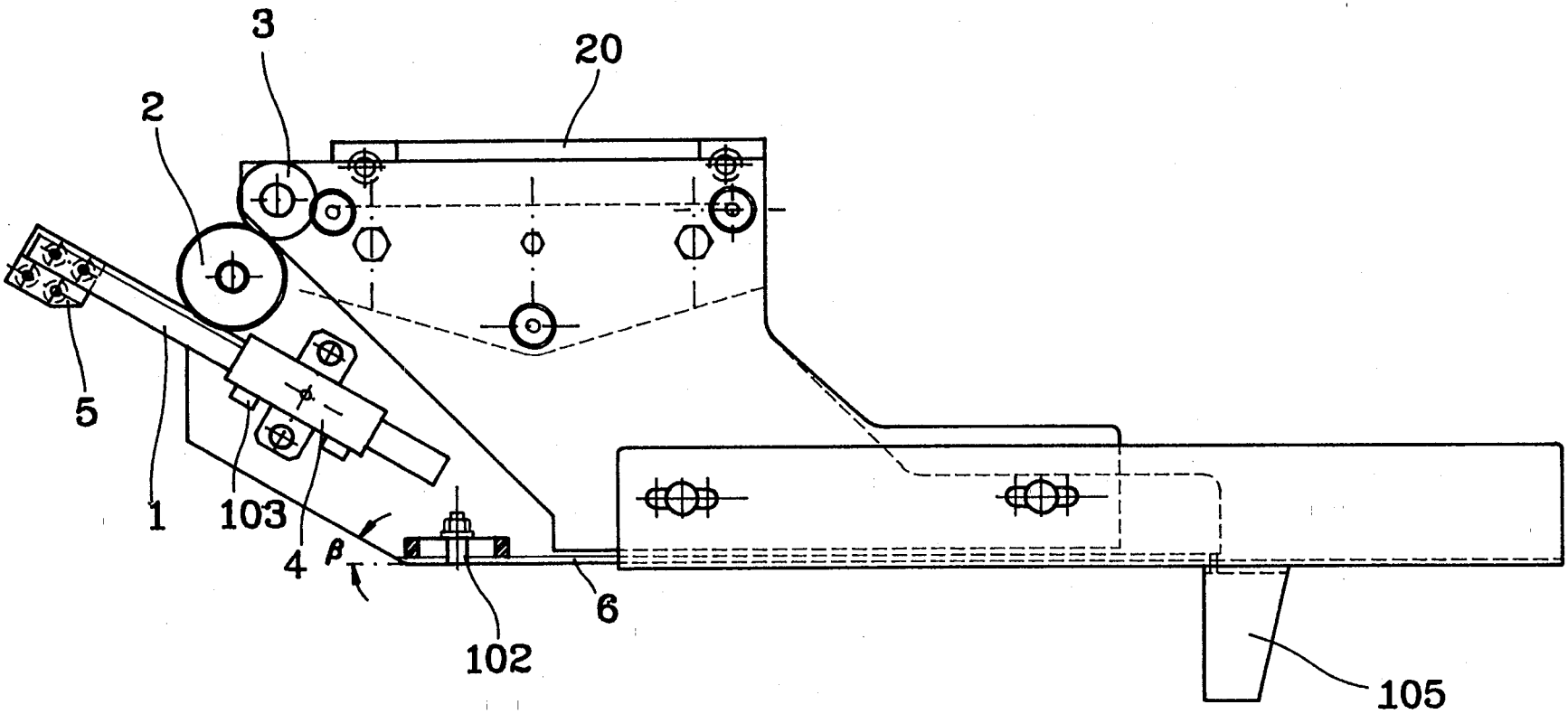
FIG. 1 is a front view of an embodiment according to the present invention.
Figure 2:
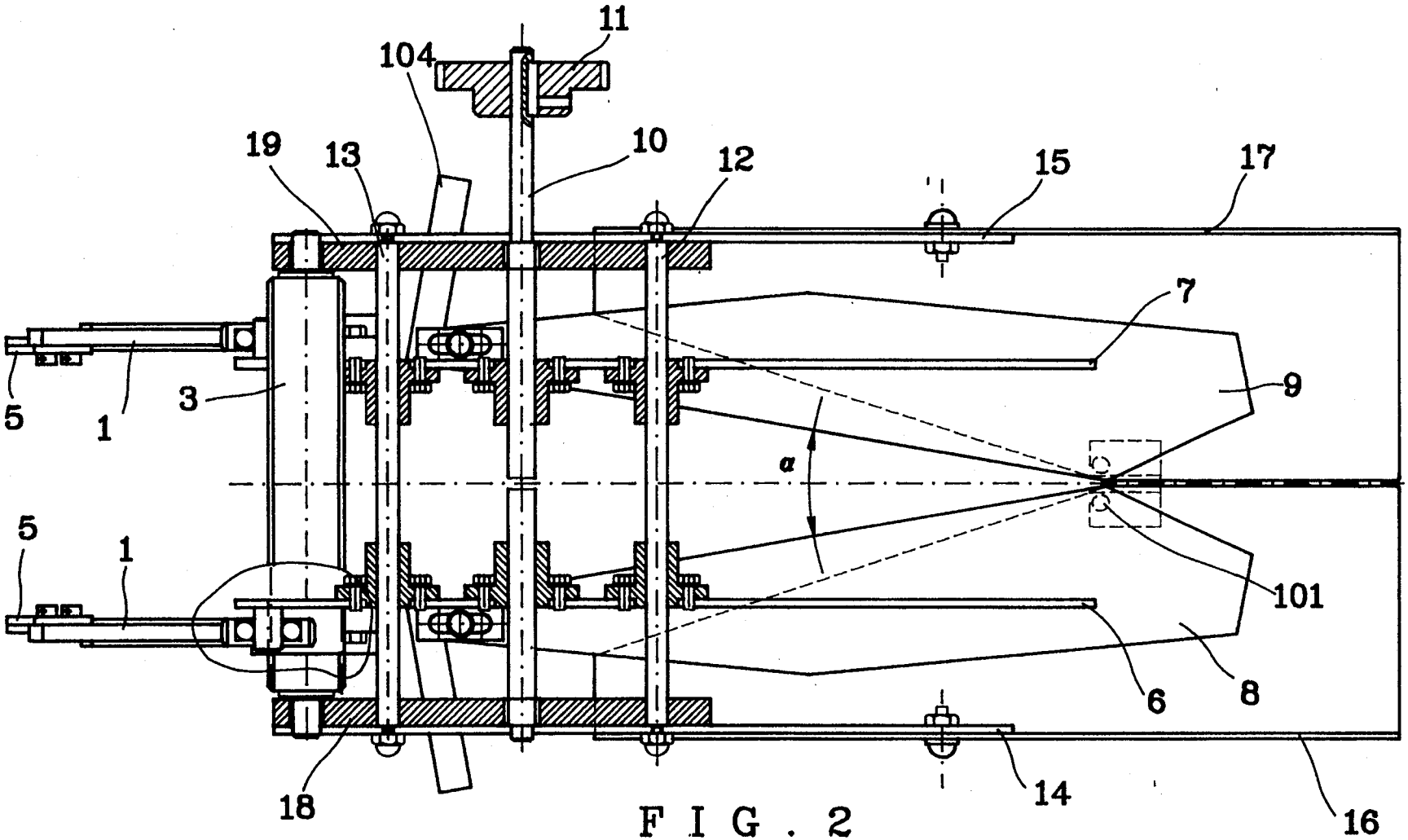
FIG. 2 is a top view of the embodiment shown in FIG. 1.

Referring to FIGS. 1 and 2, the embodiment of the present invention comprises two gear racks 1, two gears 2, a gear 3, two gear rack bases 4, two paper-guiding plates 5, two width-adjusting plates 6 and 7, two paper-conveying-locus guide plates 8 and 9, a guide screw 10, a gear 11, two guide rods 12 and 13, two side plates 14 and 15, two base plates 16 and 17, two fixed blocks 18 and 19 and a connecting plate 20; further, the present invention comprises two rotary connectors 101 and 102, four guide bolts 103 and two guide plates 104 and 105. The parts, such as the width-adjusting plates 6 and 7, the paper-conveying-locus guide plates 8 and 9, a guide screw 10, and the base plates 16 and 17, are formed into a geometric structure so as to match the change of specifications of a pouch, and to modify the locus of the packing paper.

Figure 3A:
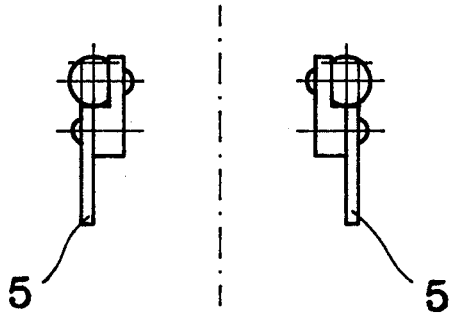
FIG. 3 illustrates two different forms of paper-guiding plates according to the present invention.
Figure 3B:
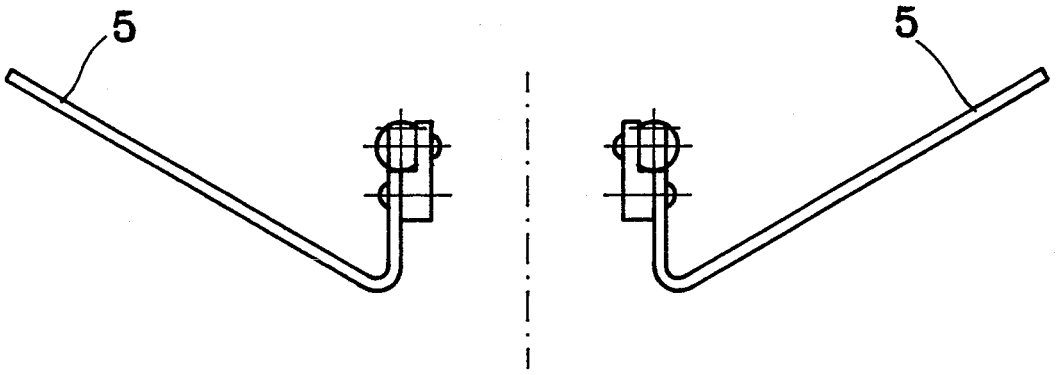

In the event of the height of a product to be packed being changed, the height of the paper-guiding plate 5 can be changed by means of the adjustment of the gear racks 1; the paper-guiding plate 5 is mounted on the rear end of gear rack 1, and it may be adjusted by means of a gear 3 and gear 2 to drive the gear racks 1 synchronously so as to have the two paper-guiding plates 5 synchronously adjusted to the height desired. In order to prevent the gear racks 1 from swinging while moving in parallel, each of the gear racks 1 is milled with a keyway and two guide bolts 103 mounted in the gear rack base 4. The paper-guiding plates 5 may be selected with a given form (as shown in FIGS. 3(A) and 3(B) in accordance with different requirements. As shown in FIG. 1, the angle "$\beta$" indicates the guiding angle upon the packing paper entering the pouch former; such angle "$\beta$" can affect the moving locus of the packing paper, and such angle can be adjusted slightly by adjusting the gear rack base 4.

The width of the pouch, is controlled with the two width-adjusting plates 6 and 7, which are driven by the rotation of a guide screw 10 having half left-handed threads and half right-handed threads, and then width-adjusting the plates 6 and 7 can be moved inwards or outwards simultaneously. The distance between the width-adjusting plates 6 and 7 can be limited with two guide rods 12 and 13 so as to have the width-adjusting plates 6 and 7 moved along a given locus in a parallel motion.

As shown in FIG. 2, the paper-conveying-locus guide plates 8 and 9 are connected together with the base plates 16 and 17 by means of a rotary connector 101 so as to let the paper-conveying-locus guide plates 8 and 9 rotate freely. The rotary connector 102 is used as a connector with a long slot; in other words, the paper-converging-locus guide plates 8 and 9 and the width-adjusting plates 6 and 7 are connected together into a quadrilateral assembly; when the width-adjusting plates 6 and 7 are moving, the paper-conveying-locus guide plates 8 and 9 will also be rotated to form an angle "$\alpha$" adjustment. The angle "$\alpha$" is related to the converging locus of the packing paper, i.e., the locus of the packing paper will vary with the change of the width of a product, and such requirement can be met with the present invention. The gear 2 is fixedly mounted on the width-adjusting plates 6 and 7; therefore, when the width-adjusting plates 6 and 7 are moved, the gear 2 will be moved, too. The gear 3 is substantially a cylindrical gear for matching the aforesaid requirement, i.e., no matter what adjustment extent of the width-adjusting plates 6 and 7 may change, the gear 2 and gear 3 will be in mesh. The side plates 14 and 15 and the connecting plate 20 form the outer structure of the pouch former. The base plates 16 and 17 are fastened to the side plates 14 and 15 respectively; the guide plate 105 is used for guiding a packing paper to enter a paper-pulling assembly to complete the forming process of the pouch former. The guide plate 104 is used for controlling a packing paper to enter the passage formed with the paper-conveying-locus guide plates 8 and 9, and also for limiting the passage of the packing paper so as to prevent it from being affected by the side plates 14 and 15. FIGS. 3(A) and 3(B) illustrate different forms of the paper-guiding plates 5; the user may select one of them during operation in accordance with the product feature, the characteristics of the packing paper and the size and form of products. According to the present invention, the paper-guiding plates 5 are designed into several standard assembly forms to facilitate change, if necessary.

The present invention not only can be used in a horizontal (or lying) type of packing machine, but also can be used in a vertical type of packing machine. The present invention can also be furnished with a driving power to enable the device to adjust the specifications of the pouch former automatically.

We claim:

1. A horizontal type of packing machine with an adjustable pouch former having two sides and bottom, said pouch former comprising a pair of paper-guiding plates for guiding a packing paper into said pouch former, a pair of width-adjusting plates at said two sides, respectively, of said pouch former, a pair of paper-conveying-locus guide plates connected to said pair of width-adjusting plates, respectively, at least two base plates at the bottom of said pouch former, said paper-conveying-locus guide plates being pivotably affixed to said base plates, respectively, by a rotary connector means such that said paper-conveying-locus guide plates are disposed at a conveying angle relative to each other, said conveying angle being made to vary corresponding to a distance formed between said pair of width-adjusting plates;

an elongated guide screw for adjusting the distance between said pair of width-adjusting plates, said guide screw comprising a left-handed thread portion and a right-handed thread portion so as to simultaneously move said width-adjusting plates inwardly or outwardly to adjust said conveying angle by pivoting said guide plates about said rotary connector; and two guide rods slidably affixed to said width-adjusting plates so as to limit said width-adjusting plates to parallel motions relative to each other;

wherein said width-adjusting plates, said paper-conveying-locus guide plates and said base plates are adapted to be adjustably formed into a predetermined geometric shape and dimension so as to match a predetermined shape of the pouch to be formed and modify the locus of the packing paper.

2. A horizontal type of packing machine with an adjustable pouch former according to claim 1, wherein said paper-guiding plates are replaceable members which can be replaced in accordance with the feature of a product to be pouched and the packing paper characteristics.

3. A horizontal type of packing machine with an adjustable pouch former according to claim 1, wherein said paper-guiding plates are provided with a height-adjusting means for adjusting the height thereof, said height-adjusting means comprising a first gear, a pair of second gears and a pair of gear racks, each of said paper-guiding plates being fastened to one of said gear racks; and said first gear is an elongated gear in mesh with both of said pair of second gears, and said second gears being in mesh with said pair of gear racks, respectively, such that said paper-guiding plates can be adjusted of their height in a synchronous manner by a turning of said first gear.

4. A horizontal type of packing machine with an adjustable pouch former according to claim 3, wherein each of said gear racks is milled with a keyway; and said height-adjusting means further comprises a pair of gear rack bases, each of said gear racks being slidably received by one of said gear rack bases by a guide bolt, which penetrates through a wall of said gear rack base and engages with said keyway of said gear rack so as to prevent said gear rack from swinging and to maintain said gear rack and said gear rack base to move in parallel.

5. A horizontal type of packing machine with an adjustable pouch former according to claim 1, wherein said paper-conveying-locus guide plates and said base plates are fastened together by said rotary connector so as to allow said paper-conveying-locus guide plates to rotate freely;

said paper-conveying-locus guide plates and said width-adjusting plates are connected together by means of a second rotary connector with a long slot so as to form a near-quadrilateral assembly, which enables said paper-conveying-locus guide plates to pivot when said width-adjusting plates are moved.

* * * * *